US005960482A

United States Patent [19]

Chang

[11] Patent Number: 5,960,482

[45] Date of Patent: Oct. 5, 1999

[54] FLUSHING WATER CONTROL DEVICE FOR A TOILET TANK

[76] Inventor: I-Yao Chang, No. 17, Chiao-Ai 4 Rd., Hsintien City, Taipei Hsien, Taiwan

[21] Appl. No.: 09/265,976

[22] Filed: Mar. 11, 1999

[51] Int. Cl.[6] ..... E03D 1/14

[52] U.S. Cl. ..... 4/325; 4/412

[58] Field of Search ..... 4/324–327, 405, 4/412

[56] References Cited

U.S. PATENT DOCUMENTS

| | | | |
|---|---|---|---|
| 1,015,453 | 1/1912 | Moseley | 4/412 |
| 2,412,738 | 12/1946 | Martin | 4/412 |
| 4,175,296 | 11/1979 | Goldman | 4/325 |
| 4,225,987 | 10/1980 | Goldman et al. | 4/324 |
| 5,157,795 | 10/1992 | Pasquin | 4/324 |
| 5,459,885 | 10/1995 | Gaw | 4/325 |

*Primary Examiner*—Charles R. Eloshway
*Attorney, Agent, or Firm*—Bacon & Thomas, PLLC

[57] ABSTRACT

A device for controlling different amounts of flushing water out of a toilet tank includes a casing having a through-hole defined therein and a pair of channels formed on both sides thereof; a shaft rotatably arranged in the casing with the front end extending out through the through-hole, the shaft being spring-loaded to define a rotationally initial position and so as to urge itself to return to the initial position after rotation; a disk secured to the shaft and having a pair of posts spaced apart at a predetermined angular distance; a reel having a peripheral recess for receiving a string, the string being fixedly attached to the reel; a pair of trigger members pivotally connected to the casing, each trigger member being pivotal to a first position in which one of the posts is retained by the trigger member after the shaft is rotated away from the initial position through a respective angle, and to a second position in which the post is released to return to the initial position; a pair of poles movable through the channels in the casing and having respective floats attached to lower ends thereof. The poles are connected to the trigger members so that each of the trigger members is maintained in the first position when water in the toilet tank is full but pivots away from the first position to the second position when the float thereof goes downward with the water level within the toilet tank.

2 Claims, 9 Drawing Sheets

FLUSHING WATER CONTROL DEVICE FOR A TOILET TANK

FIELD OF THE INVENTION

The present invention relates to a flushing water control device for a toilet tank and, more particularly, to a device for controlling different amounts of flushing water discharged from a toilet tank.

BACKGROUND OF THE INVENTION

A toilet generally includes a bowl and a toilet tank. As shown in FIG. 9, the conventional toilet tank (90) typically includes a discharge tube (91), an overflow tube (92) and a valve cap (93) pivotally connected to the overflow tube (91) to selectively close the discharge tube (91). The operation of the valve cap (93) is controlled by a string (96) connected to an arm (95) that is rotatable by a handle (94).

As illustrated, when the handle (94) is rotated, the string (96) is lifted by the arm (95) and the valve cap (93) is pivoted from a closed position to an open position to discharge water from the toilet tank (90). The valve cap (93) returns to the closed position once the discharge is completed, and the toilet tank (90) is ready to be refilled.

A disadvantage of the conventional toilet tank (90) is that water therein is totally discharged once the handle (94) is activated, regardless of what kind of waste is in the bowl. In other words, excessive amounts of water are wasted.

SUMMARY OF THE INVENTION

The object of the present invention is to provide a device to control the amount of flushing water discharged from a toilet tank.

Another object of the present invention is to provide such a device for application with any conventional toilet tank.

DETAILED DESCRIPTION OF PREFERRED EMBODIMENT

Figure 1:
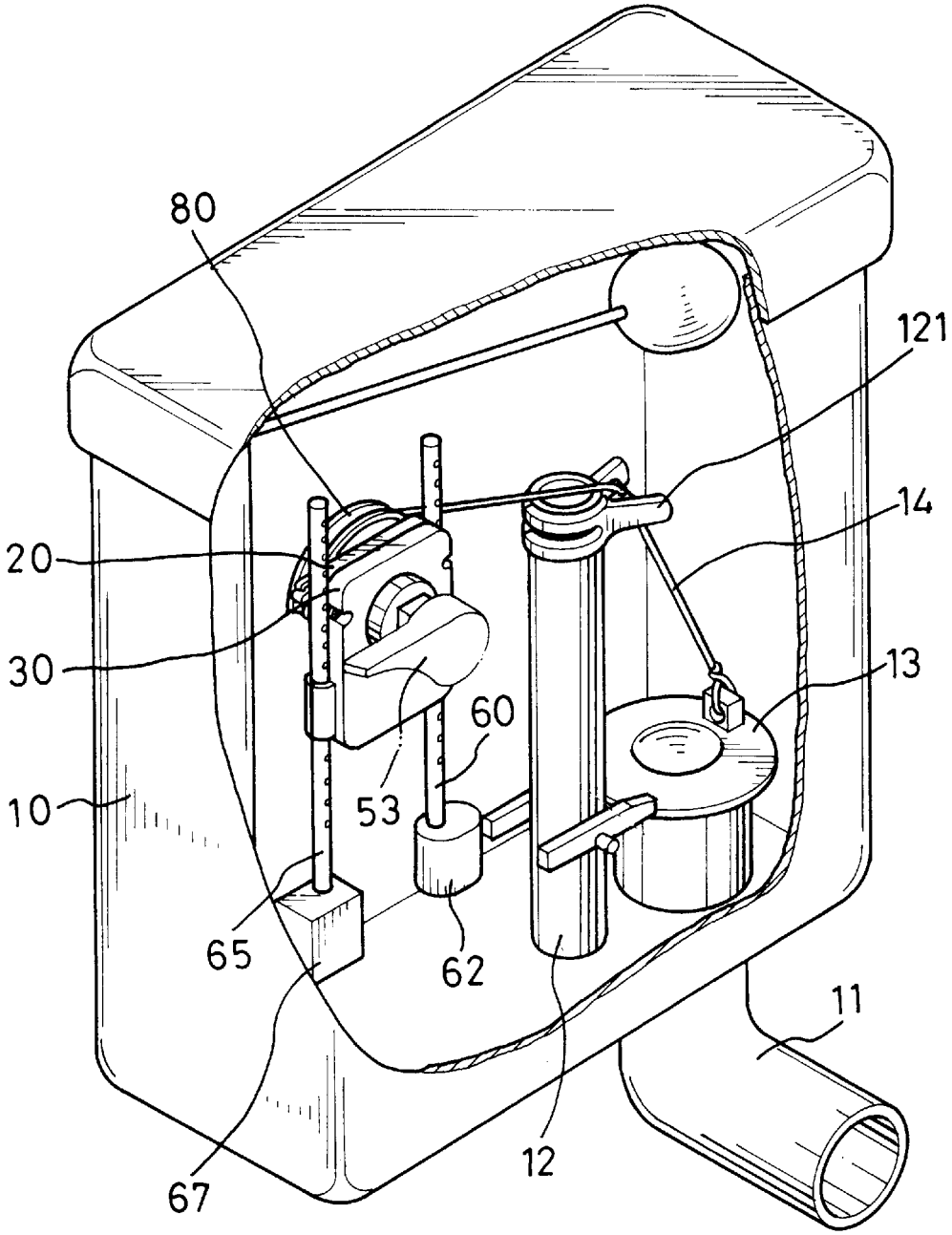
FIG. 1 is a perspective view, partially cut-away, of a toilet tank incorporating a device in accordance with the present invention for controlling the discharge of different amounts of flushing water from a toilet tank.

Referring to FIG. 1, a toilet tank (10) is shown cooperating with a device in accordance with the present invention to control the discharge of different amounts of flushing water from a toilet tank (10).

As illustrated, the toilet tank (10) in accordance with the present invention is substantially the same as a conventional tank. For example, both include a discharge tube (11), an overflow tube (12), and a valve cap (13) pivotally connected with the overflow tube (12) to selectively close the discharge tube (11), except that the operation of the valve cap (13) is controlled by a string (14) running from the device of the present invention by way of a guide fork (121) that is mounted on the top end of the overflow tube (12).

Figure 2:
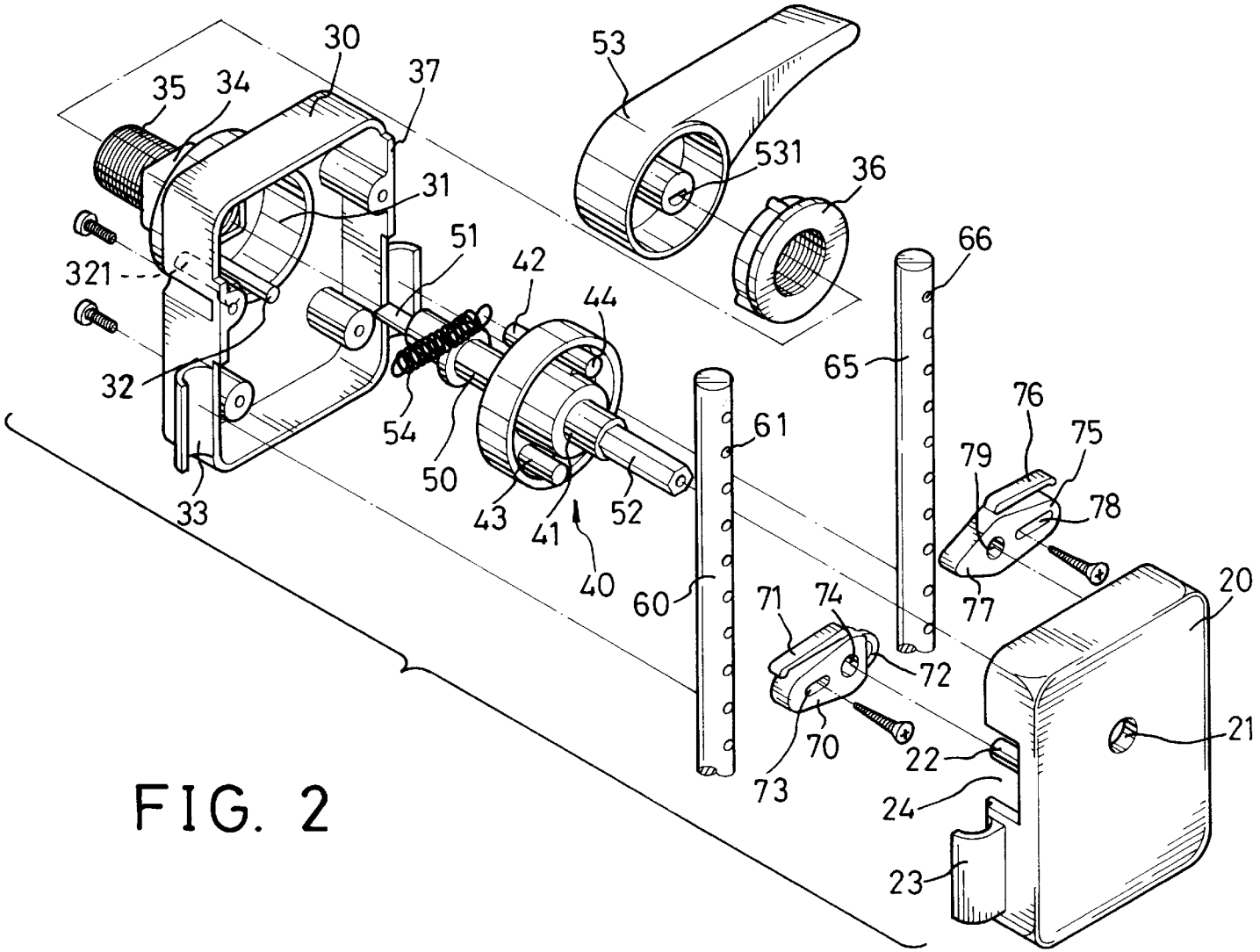
FIG. 2 is an exploded perspective view of the device shown in FIG. 1.

Referring to FIG. 2, the device of the present invention includes a casing having a front cover (30) and a rear cover (20) which are attached to each other. The casing has a bore (21) defined in the rear cover (20), a threaded tubular portion (35) extending outward from the front cover (30), and a non-circular positioning seat (34) at the proximal end of the threaded tubular portion (35).

Rotatably arranged in the casing is a shaft (50) that has a front end (51) extending out of the casing through a through-hole defined by the threaded tubular portion (35), and a rear hexagonal end (52) extending out of the casing through the bore (21).

A disk (40) is securely mounted or keyed around the shaft (50) between the ends (51, 52) and is preferably received in a recess (31) defined in the front cover (30). The disk (40) has a first post (43) and a second post (44) both projecting therefrom at a predetermined angular distance. The shaft (50) and the disk (40) are spring-loaded, by a spring (54) that has a first end attached to a post (321) formed on the front cover (30) and a second end attached to a post (42) formed on the disk (40), to define an initial rotation position to which the spring-loaded shaft (50) tends to return after being rotated.

Preferably, the disk (40) has an arcuate slot (45) (shown in FIG. 4) defined therein to receive a pintle (32) extending from the front cover (30), to limit the rotation of the handle (53) and shaft (50) assembly.

Referring again to FIG. 2, the rear cover (20) defines a pair of notches (24) on opposite sides thereof for receiving a pair of corresponding extensions (37) on opposite sides of the front cover (20). The notches (24) and the extensions (37) are so dimensioned that rectangular openings are defined on the sides of the casing when the covers (20, 30) are joined together, so as to provide access for a first trigger member (70) and a second trigger member (75).

The first and second trigger members (70, 75) are pivotally connected to the casing by respective pins (22) that extend from the rear cover (20) into orifices (74, 79) in the trigger members (70, 75). The first trigger member (70) includes a curved leaf spring (72) on the inner end thereof, a first slot (73) defined in the outer end thereof, and a first flat spring (71) extending therefrom, while the second trigger member (75) includes a ridge (77) on the inner end thereof, a second slot (78) defined in the outer end thereof, and a second flat spring (76) extending therefrom.

In addition, on both sides of the casing there are provided a pair of channels, defined by sleeve halves (23) on the rear cover (20) and sleeve halves (33) on the front cover (30), to provide guidance for a first pole (60) and a second pole (65) respectively.

The first pole (60) includes a plurality of first threaded holes (61) defined therein and a first float (62) (see FIG. 1) attached to the lower end thereof. Similarly, the second pole (65) includes a plurality of second threaded hole (66) defined therein and a second float (67) (also see FIG. 1) attached to the lower end thereof.

Both poles (60, 65) are pivotally connected to the respective trigger members (70, 75) by means of screws (not numbered) which extend through the slots (73, 78) in the trigger members (70, 75) and are screwed into one of the threaded bole (61, 66) in the respective poles (60, 65), whereby the trigger members (70, 75) may be pivoted by the buoyancy -of the poles (60, 65) and floats (62, 65) when the water in the toilet tank (10) rises or falls.

Figure 3:
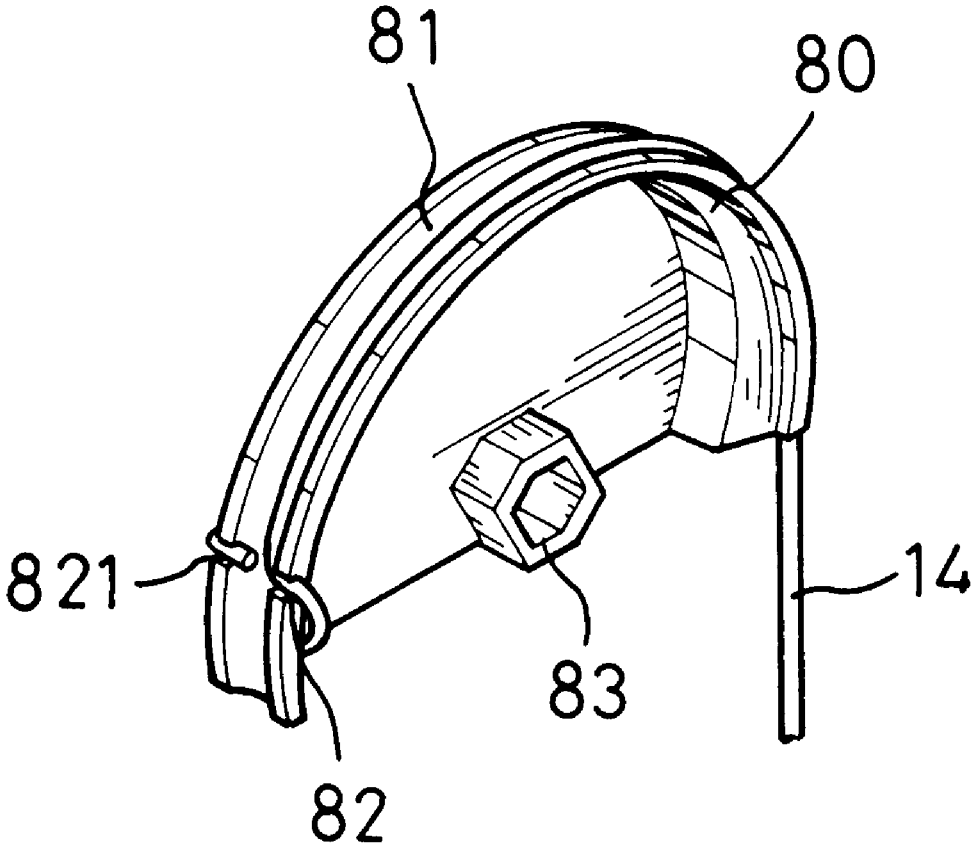
FIG. 3 is a perspective view of the reel involved in the device of the present invention.

Referring to FIGS. 1 and 3, a reel (80) is mounted around the shaft (50) near the rear end (52). The reel (80) includes a hexagonal hole (83) corresponding to the rear end (52) of the shaft (50) to ensure the reel (80) rotates with the shaft (50), and a peripheral groove (81) for receiving the string (14), which has an end fixedly attached thereto. A pair of opposed splits (82, 821) are defined in the periphery of the reel (80) across the recess (81), so the end of the string (14) can be easily attached to the reel (80) by holding the string (14) in the splits (82, 821) with at least one turn of the string (14) around the reel (80).

From the foregoing, it is clear that the device of the present invention can be easily installed in the toilet tank (10), by means of extending the threaded tubular portion (35) through an aperture defined in a side-wall of the toilet tank (10) until the non-circular positioning seat (34) is held therein. A nut (36) is then tightly screwed onto the threaded tubular portion (35) to fix the threaded tubular portion (35) in the toilet tank (10), and a handle (53) is attached to the front end (51) of the shaft (50) by inserting the end (51) into a mating orifice (531) defined in the handle (531), thereby providing the means for a user to rotate the shaft (50) of the device.

Figure 4:
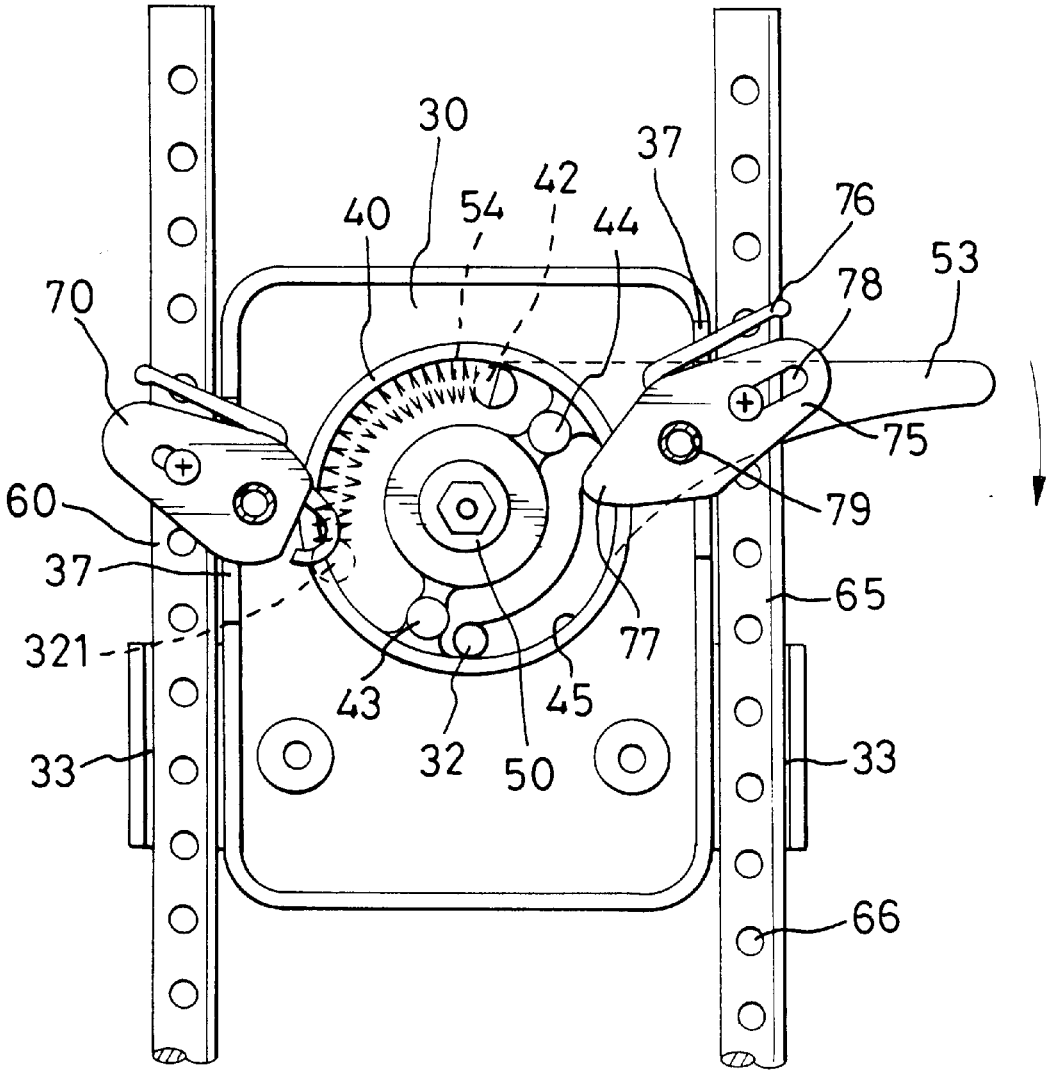
FIG. 4 is a schematic view showing the shaft of the device in the initial position.

Referring to FIGS. 1 and 4, when the toilet tank (10) is filled with water, the floats (62, 67) are fully immersed in the water. At this time, the maximum buoyant forces are exerted on the floats (62, 76), so the poles (60, 65) pivot the trigger members (70, 75) in opposite directions to such a position in which the flat springs (71, 76) of the trigger members (70, 75) are pressed against the rim of the respective rectangular openings in the casing. The flat springs (71, 76) are deformed but still allow further pivotal movement of the trigger members (70, 75) in these directions.

Figure 5:
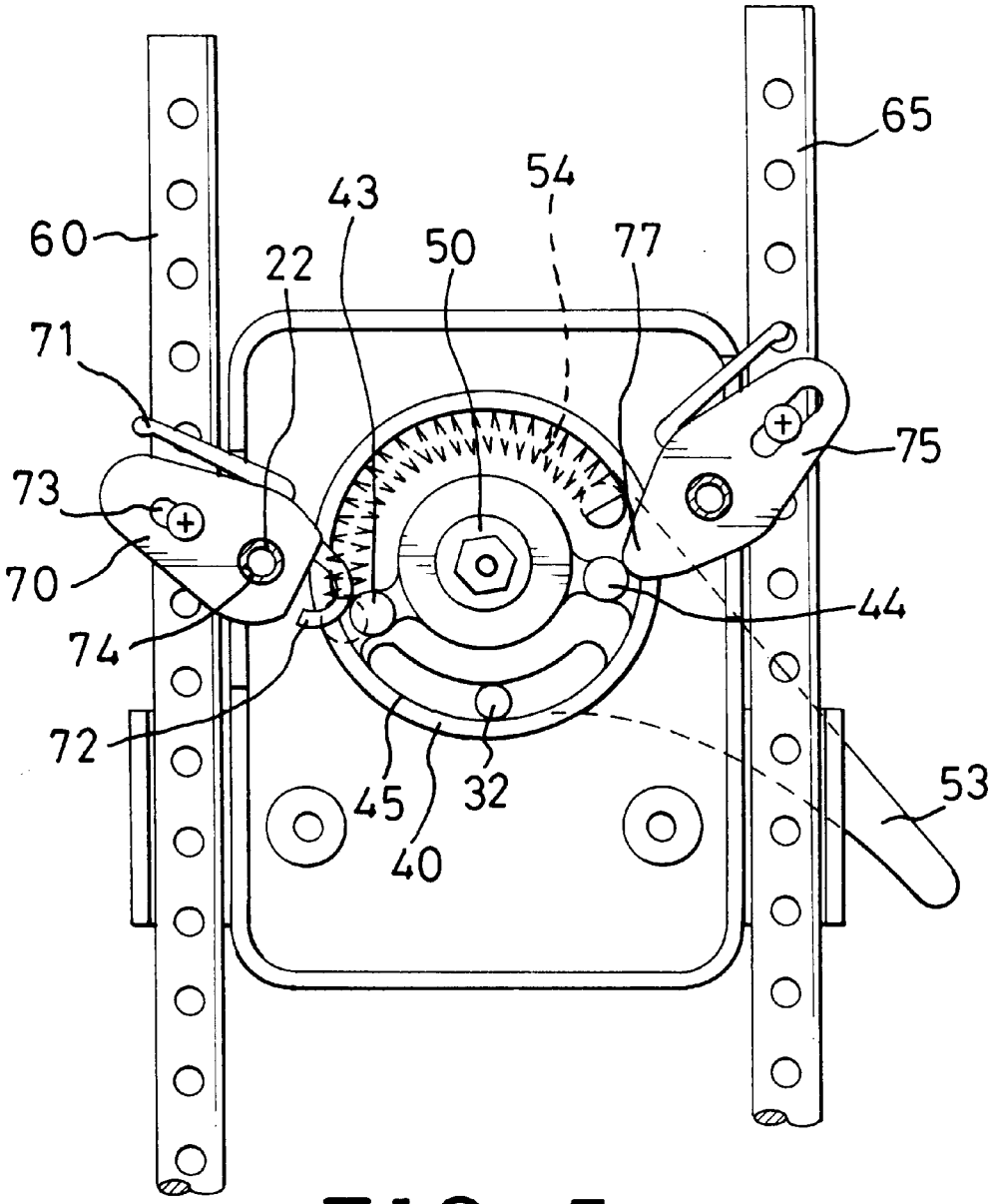
FIG. 5 is a schematic view showing the device in operation to discharge a small amount of water.

Referring to FIGS. 1 and 5, if there is a need to discharge a small amount of water out of the toilet tank (10), such as for liquid waste, the handle (53) is rotated in a clockwise direction when viewed from the direction of FIG. 5 to a related angular position, which is preferred marked "small" in the appropriate location near the handle (53) on the outside wall of the toilet tank (10).

Referring to FIG. 5, the second post (44) of the disk (40) presses and pivots the second trigger member (75) in the counterclockwise direction, and slides over the upper surface of the trigger member (75) beyond the ridge (77), and the second trigger member (75) is pivoted back in a clockwise direction by the force of the deformed flat spring (76). The path of the second post (44) and hence the shaft (50) to return to the initial rotation position thereof is thus blocked, and the second post (44) abuts the lower surface of the second trigger member (75) by the force of the stretched spring (54), when the handle (53) is released.

As a result, the reel (80) mounted around the shaft (50) is rotated through the same angle and remains there. This causes the sting (14) to be pulled back and the valve cap (13) to be pivoted from the closed position to a partially opened position, thereby allowing the water in the toilet tank (10) to be discharged therefrom.

Figure 6:
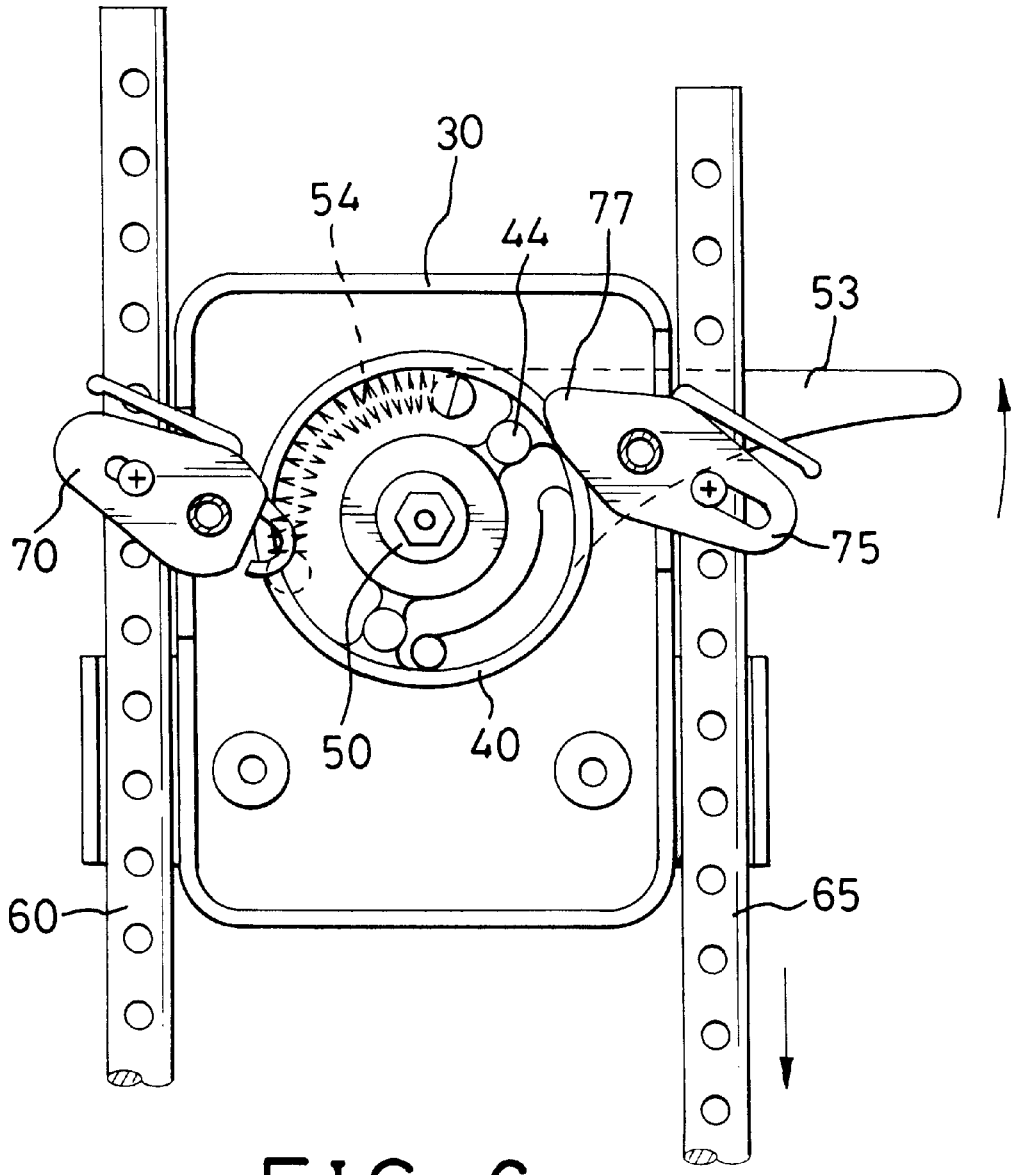
FIG. 6 is a schematic view showing the device in operation to stop the discharge in relation to a small discharge.

Referring to FIG. 6, with the continuous falling of the water level within the toilet tank (10) due to the discharge, the second float (67) emerges from the water and the buoyant force exerted thereon is decreased. Therefore, the second pole (65) moves downward and the second trigger member (75) is pivoted clockwise by the motion of the second post (44), which now slides over the lower surface of the second trigger member (75) till it moves beyond the ridge (77). It is at this point that the path for the second post (44) and the shaft (50) to return to the initial position thereof is cleared, allowing the spring-loaded shaft (50) to be rapidly rotated to the initial position.

The movement of the shaft (50) returns the reel (80) mounted thereon to its initial position, so that the string (14) is released and the valve cap (13) pivots from the partially opened position to the closed position, thereby closing the discharge tube (11).

Figure 7:
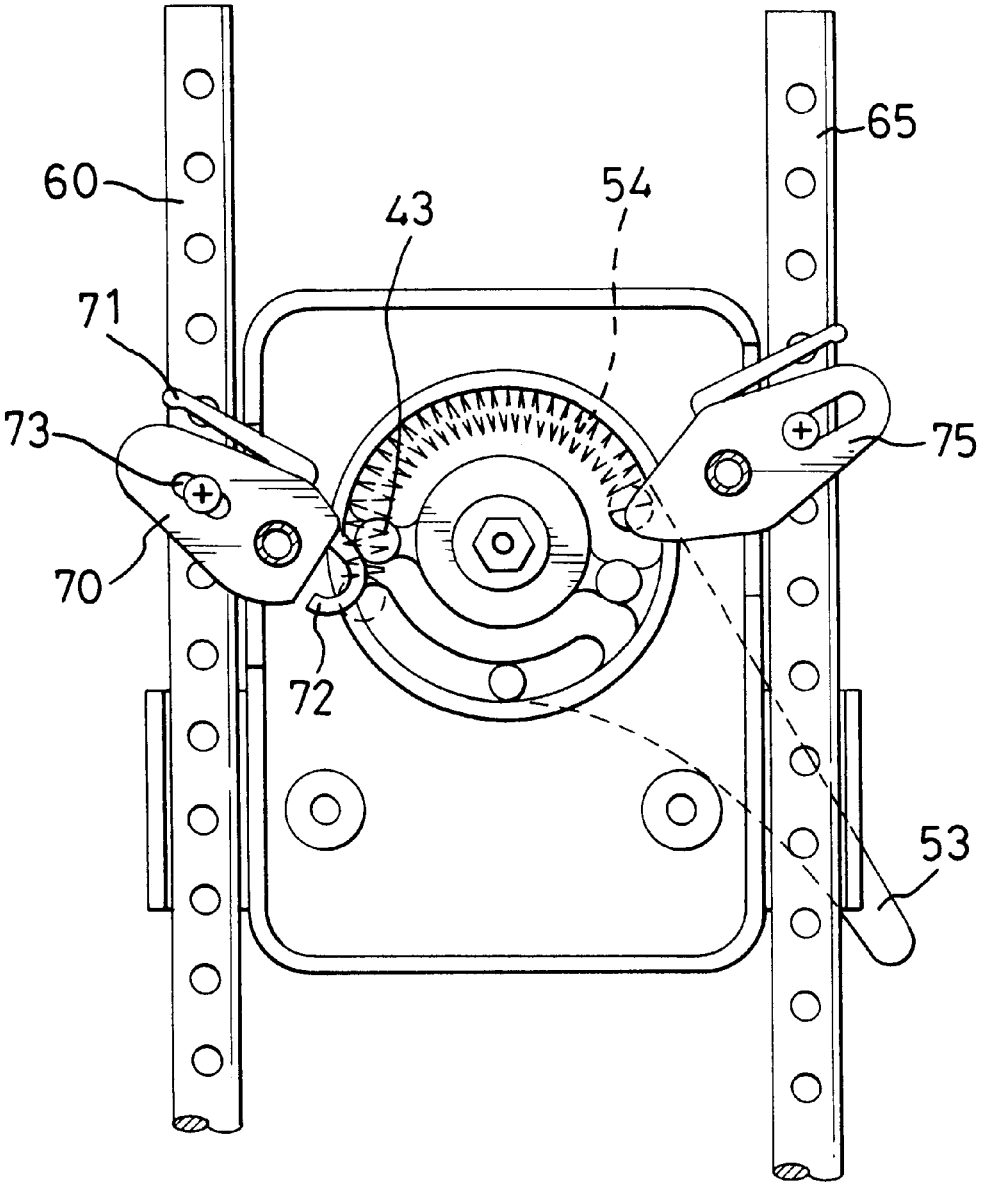
FIG. 7 is a schematic view showing the device in operation to discharge a large amount of water.

Referring to FIGS. 1 and 7, if it is necessary to discharge a large amount of water from the toilet tank (10), such as for solid waste, the handle (53) is also rotated in the clockwise direction but to a further angular position preferably marked with "large amount". During this process, the first post (43) of the disk (40) slides over the flexible curved spring leaf (72) of the first trigger member (70). Once the handle (53) is released, the first post (43) abuts the upper surface of the trigger member (70), mostly likely of the curved spring leaf (72) as shown in FIG. 7, thereby being retained there. It is important that the stiffness of the first flat spring (71) be selected to resist the clockwise torque applied by the spring-loaded post (43) and the buoyant pole (60) on the first trigger member (70) at this time.

As in the previous case, the reel (80) is rotated, pulling the string (14) and thus pivot the valve cap (13) from the closed position to a fully opened position.

Figure 8:
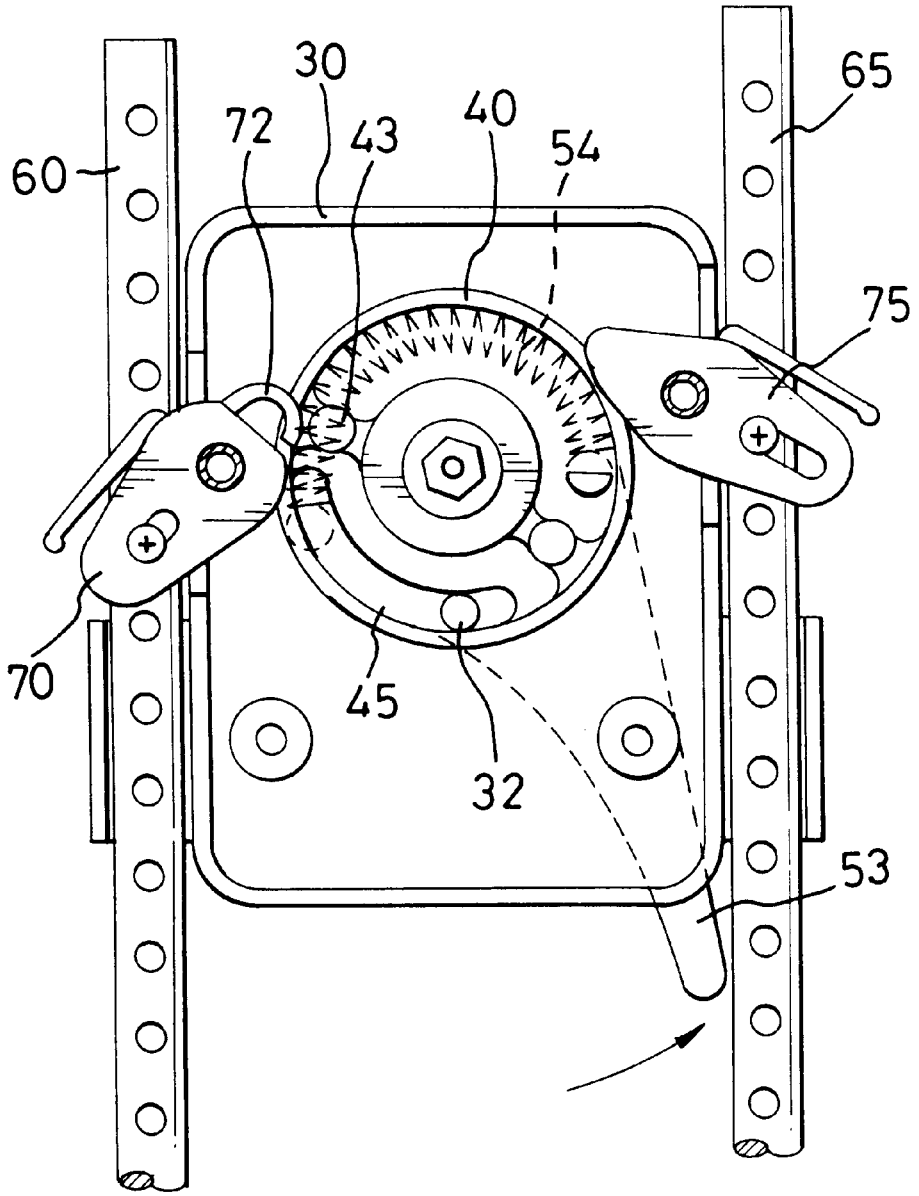
FIG. 8 is a schematic view showing the device in operation to stop the discharge in relation to the large amount of water.
Figure 9:
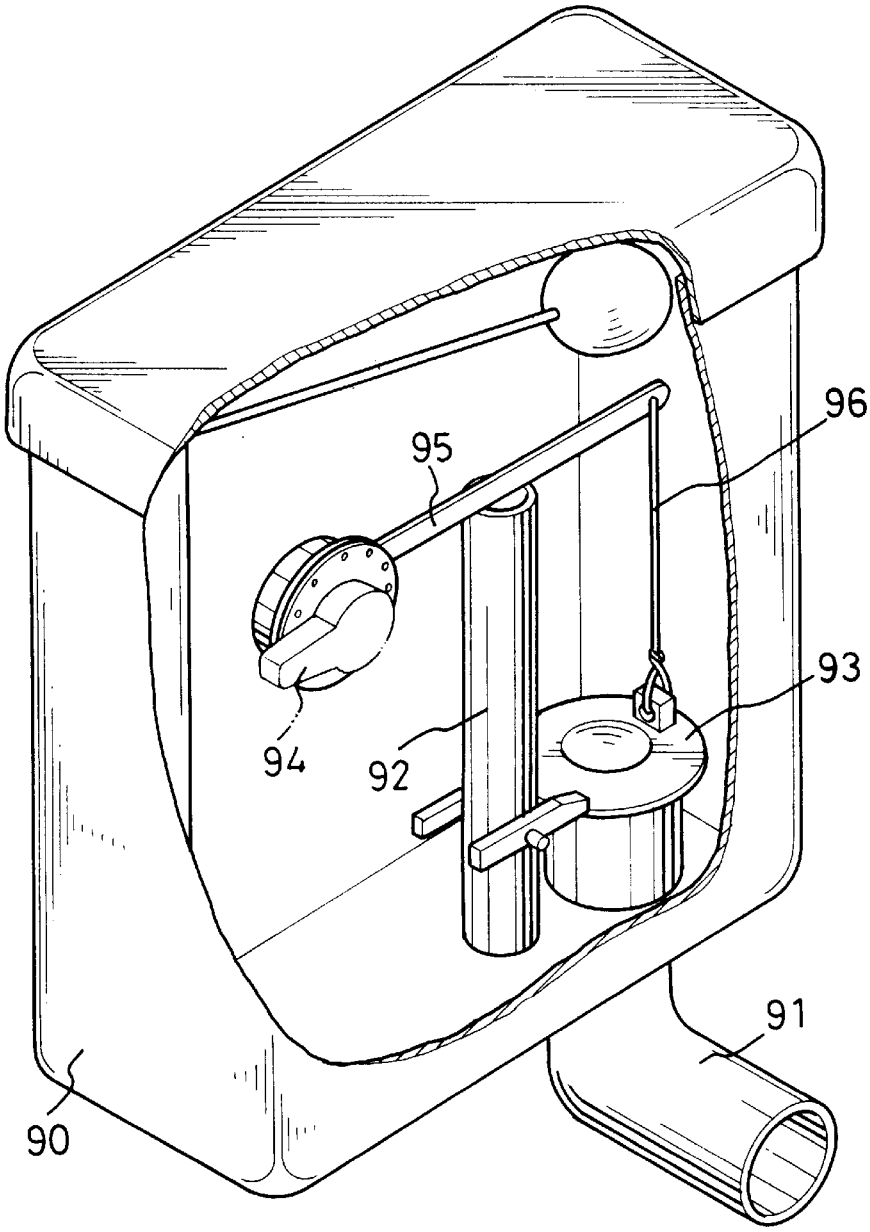
FIG. 9 PRIOR ART
FIG. 9 is a perspective view, partially cut-away, of a conventional toilet tank.

Referring to FIG. 8, when the water lever falls so that the first float (62) emerges from the water, the first pole (60) moves downward and the first trigger member (70) is pivoted counterclockwise by the force of the deformed flat spring (71), with the first post (43) being pushed towards an extreme rotated position thereof. Finally, the trigger member (70) is brought out of contact with the post (43), when the unblocked the shaft (50) rapidly returns to its original position.

As a consequence, the reel (80) returns to its original position and the string (14) is released, thereby allowing the valve cap (13) to pivot from the fully opened position to the closed position to close the discharge tube (11).

It is to be noted that the arced groove (45) defined in the disk (40) and the cooperating pintle (32) are provided to limit the movement of the first post (43) to a range between the initial position and the extreme rotated position of the post (43), or slightly more, so as to prevent excessive rotation of the shaft (50).

The device in accordance with the present invention is advantageous in that two different amounts of flushing water can be discharged from the toilet tank (10), depending on the desired application. Moreover, the amounts of water are adjustable separately, by changing the height of the floats (62, 65) with respect to the toilet tank (10), i.e. by driving the screws mentioned above into the other threaded holes (61, 66) in the respective poles (60, 65).

In addition, the string (14) can be attached to the reel (80) simply by pressing the string (14) in the splits (82, 821) formed in the reel (80) with at least one turn around, thereby the user can easily adjust the length of the string (14) between the reel (80) and the valve cap (13) during installation of the device.

It is more important that the device in accordance with the present invention can be applied to any conventional toilet tanks, by removing the original arm and by replacing the original valve cap which has a bubble therein with a valve cap, which has no bubble, in accordance with the present invention.

What is claimed is:

1. A flushing water control device for a toilet tank to discharge different amounts of flushing water from a toilet tank, comprising:

a casing having a through-hole defined therein and a pair of channels formed on both sides thereof;

a shaft having a front end and a rear end, said shaft being rotatably arranged in said casing with said front end extending out through said through-hole, said shaft being spring-loaded to define an initial rotation position and to force itself to return to said initial position after being rotated;

a disk secured to said shaft between said ends and having a pair of posts spaced apart at a predetermined angular distance;

a reel mounted around said shaft near said rear end and having a peripheral recess for receiving a string, said string having an end fixedly attached to said reel;

a pair of trigger members pivotally connected to said casing, each trigger member being pivotal to a first position in which one of said posts is retained by said trigger member after said shaft is rotated away from said initial position through a respective angle, and to a second position in which said post is released to return to said initial position;

a pair of poles movable through said channels in said casing and having respective floats attached to lower ends thereof; and wherein said poles are connected to said trigger members so that each of said trigger members is maintained in said first position when water in said toilet tank is at full level but pivots away from said first position to said second position when said float thereof goes down with ebbing water level within said toilet tank.

2. The device as claimed in claim 1, wherein said reel has cut-out splits defined therein to hold said end of said string.

* * * * *